US012745810B2

(12) United States Patent
Hicken

(10) Patent No.: US 12,745,810 B2
(45) Date of Patent: Sep. 29, 2026

(54) NECKTIE SECURING DEVICE, AND RELATED DEVICES, SYSTEMS, AND METHODS

(71) Applicant: Justin Matthew Hicken, Spanish Fork, UT (US)

(72) Inventor: Justin Matthew Hicken, Spanish Fork, UT (US)

( * ) Notice: Subject to any disclaimer, the term of this patent is extended or adjusted under 35 U.S.C. 154(b) by 0 days.

(21) Appl. No.: 19/313,265

(22) Filed: Aug. 28, 2025

(65) Prior Publication Data

US 2026/0107999 A1 Apr. 23, 2026

Related U.S. Application Data

(60) Provisional application No. 63/709,829, filed on Oct. 21, 2024.

(51) Int. Cl.
*A41D 25/00* (2006.01)

(52) U.S. Cl.
CPC ..... *A41D 25/003* (2013.01); *A41D 25/00* (2013.01); *A41D 25/005* (2013.01)

(58) Field of Classification Search
CPC ..... A41D 25/003; A41D 25/00; A41D 25/005
See application file for complete search history.

(56) References Cited

U.S. PATENT DOCUMENTS

| | | | | |
|---|---|---|---|---|
| 6,209,136 | B1 * | 4/2001 | Ophardt | A41D 25/06 2/144 |
| 7,065,794 | B2 * | 6/2006 | Anderson | A41D 25/003 223/82 |
| 7,373,696 | B2 * | 5/2008 | Schoening | A41D 25/003 24/66.1 |
| 2004/0181846 | A1 * | 9/2004 | Anderson | A41D 25/003 2/145 |
| 2006/0032026 | A1 * | 2/2006 | Schoening | A44B 6/00 2/303 |
| 2008/0172772 | A1 * | 7/2008 | Kim | A41D 25/06 2/243.1 |
| 2013/0269083 | A1 * | 10/2013 | Paglione | A41D 25/00 2/145 |
| 2021/0177075 | A1 * | 6/2021 | Hall | A41D 25/003 |

* cited by examiner

*Primary Examiner* — Khaled Annis
(74) *Attorney, Agent, or Firm* — Ashurst Perkins Coie US LLP

(57) ABSTRACT

Disclosed is a necktie including a shell forming an exterior surface of the necktie, an interlining positioned within the shell, a magnet, and a flexible magnetic member. The shell includes a first blade portion and a first tail portion, and the interlining includes a second blade portion and a second tail portion that aligns with the first blade portion and the second blade portion, respectively. The magnet is affixed to a tip of the second tail portion, and the flexible magnetic member is affixed along a length of the second blade portion. When worn, the magnet is magnetically attracted to the flexible magnetic member, securing the first blade portion to the first tail portion.

20 Claims, 3 Drawing Sheets

NECKTIE SECURING DEVICE, AND RELATED DEVICES, SYSTEMS, AND METHODS

CROSS-REFERENCE TO RELATED APPLICATION(S)

This application claims the benefit of U.S. Provisional Application No. 63/709,829, filed Oct. 21, 2024, the disclosure of which is incorporated by reference herein in its entirety.

TECHNICAL FIELD

The present technology generally relates to devices and methods for securing neckties using complementary magnetic features.

BACKGROUND

A conventional necktie typically consists of a wide front blade and a narrower rear blade, commonly referred to as the "tail." After tying the necktie, the tail is usually positioned behind the front blade. To maintain a neat appearance, it is important that the tail remains securely in place and does not become visible or misaligned during normal wear.

Various methods and devices have been developed to address the issue of securing the tail of a necktie. The most common solution is the use of a fabric loop, or "keeper loop," sewn onto the back of the front blade that the wearer typically inserts the tail through to hold the tail in place. However, this method is not always effective as the tail that hangs past the loop is free to move. Further, the keeper loop may be too loose or too tight, may become detached, or may not be present on all neckties. Additionally, the tail can slip out of the loop during movement, resulting in a disheveled appearance.

Other solutions include tie clips, pins, and adhesive strips. Tie clips and pins are primarily designed to secure the entire tie to the shirt, rather than specifically addressing the issue of the tail. As such, the necktie loses its natural movement and can bulge outward in an unappealing manner. Tie clips and pins are also sometimes visible, which can be undesirable. Adhesive strips, while effective in the short term, can damage the fabric or lose their adhesive properties over time. Thus, there is a need for devices capable of securing the entire tail in place without restricting the natural movement of the necktie.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present disclosure. For ease of reference, throughout this disclosure identical reference numbers may be used to identify identical or at least generally similar or analogous components or features.

DETAILED DESCRIPTION

Aspects of the present disclosure are directed generally towards apparatuses and methods for securing neckties using concealed magnetic features. In some embodiments, a necktie can include a shell and an interlining. The necktie can further include a blade portion (e.g., a front blade portion) and a tail portion. The interlining can be positioned within the shell and include a magnet and a flexible magnetic member attached to opposite sides of the interlining (e.g., the tail portion and the blade portion). When the necktie is worn, the magnet and the flexible magnetic member will be magnetically attracted to each other, securing the tail portion to the blade portion so that the tail remains hidden behind the blade portion of the necktie. In some embodiments, the magnet can be placed at a tip of the tail portion, and the flexible magnetic member can extend along the blade portion. In some aspects of the present technology, the entire length of the tail portion is secured behind the blade portion because the magnet is located at the end of the tail portion. In further aspects of the present technology, the elongate form of the flexible magnetic member allows the user to establish a magnetic connection between the magnet and the magnetic member regardless of how the tie is tied and/or how much of the tail portion extends past a neck portion of the necktie. In additional aspects of the present technology, affixing the magnetic member and the magnet to the interlining hides the magnetic member and the magnet from view once the interlining has been sewn into the shell, which can make securement of the necktie discrete and more aesthetically appealing. In other aspects of the present technology, the disclosed configurations allow the present technology to be implemented in traditional necktie constructions.

Certain details are set forth in the following description and in FIGS. 1A-3 to provide a thorough understanding of various embodiments of the disclosure. One skilled in the art, however, will understand that the present technology may have additional embodiments, and that other embodiments of the technology may be practiced without several of the specific features described below, while still other embodiments of the disclosure may be practiced with additional details and/or features. For example, many of the neckties described below refer to neckties that can be tied. However, in other embodiments, the neckties disclosed herein may be used for different types of neckties, such as ones that are magnetically affixed to the collar of a shirt. Other details describing well-known structures and components often associated with neckties, however, are not set forth below to avoid unnecessarily obscuring the description of various embodiments of the disclosure.

Figure 1A:
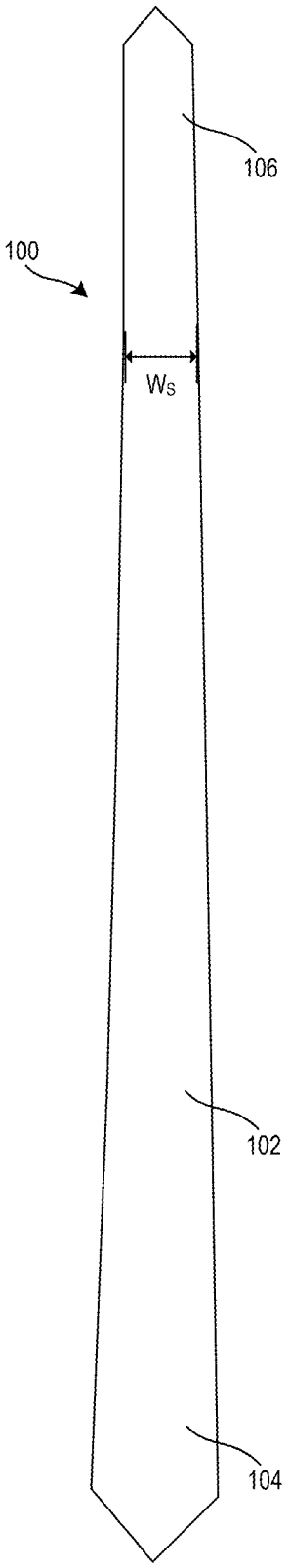
FIG. 1A is an exterior view of a shell of a necktie.
Figure 1B:
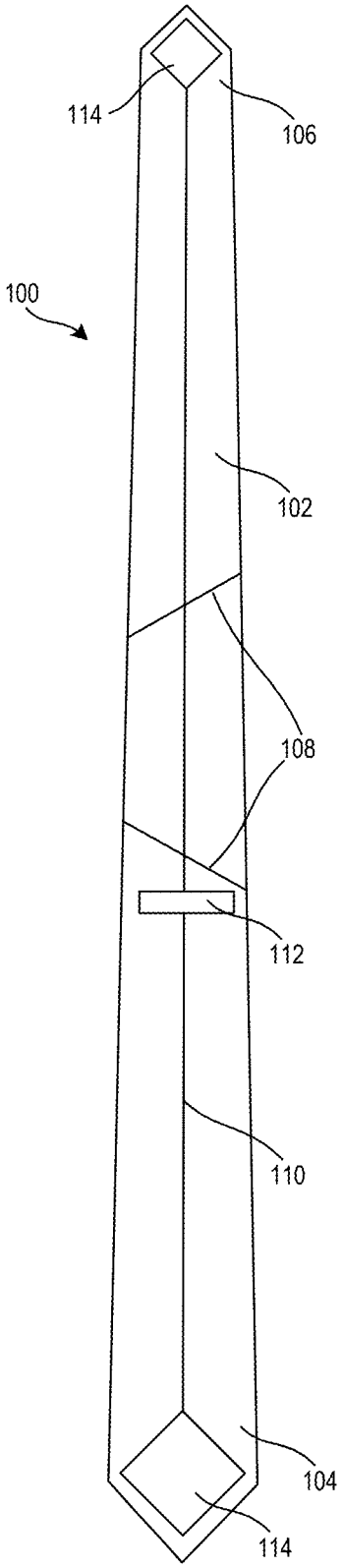
FIG. 1B is an interior view of the shell of the necktie of FIG. 1A.

FIG. 1A is an exterior view of a shell 102 of a necktie 100. FIG. 1B is an interior view of the shell 102 of the necktie 100 of FIG. 1A. Referring to FIGS. 1A and 1B, the shell 102 creates (e.g., forms) the external surfaces of the necktie 100 (e.g., the portions visible when worn, outer surfaces). In the illustrated embodiment, the necktie 100 includes a blade portion 104 (e.g., a front blade portion 104) and a tail portion 106. The shell 102 has a width $W_S$, which generally decreases from the blade portion 104 to the tail portion 106. In other embodiments, the width $W_S$ can be consistent along a length of the shell 102. In the illustrated embodiment, the necktie 100 ends in points at both the blade portion 104 and the tail portion 106; however, in other embodiments, the ends of the necktie 100 can be different shapes. In some embodiments, the necktie 100 can be made of polyester, microfiber, silk, wool, cotton, linen, and/or the like.

Referring to FIG. 1B, the shell 102 includes at least two pieces of fabric that are sewn (e.g., hand sewn, machine sewn) together at seams 108. The fabric of the shell 102 is also folded over itself and sewn in position (e.g., via a slip stitch) to create (e.g., form) an internal seam 110. Before the internal seam 110 is created, an interlining 216 (FIG. 2) can be inserted into the shell 102. In other embodiments, the interlining 216 can be omitted and/or the shell 102 can be made of a single piece of fabric. In some embodiments, the shell 102 can include a bar tack (e.g., a horizontal stitch, stitches 222 (FIG. 2)) at the blade portion 104 and/or the tail portion 106 to help secure the seams 108 and/or 110 of the shell 102. In further embodiments, the shell 102 can include a rolled edge that creates full (e.g., thick) edges along a length of the necktie 100.

In the illustrated embodiment, the interior of the shell 102 includes a keeper loop 112 (e.g., keep loop, self-loop). When the necktie 100 is tied, the tail portion 106 can be inserted through the keeper loop 112 to secure the tail portion 106. More specifically, when the tail portion 106 is inserted through the keeper loop 112, the tail portion 106 is restricted from moving. However, the keeper loop 112 does not secure the end (e.g., the tip) of the tail portion 106, which can allow part of the tail portion 106 to become visible behind the blade portion 104 when the necktie 100 is tied. In other embodiments, the keeper loop 112 can be omitted, or the shell 102 can include two or more keeper loops 112. In the illustrated embodiment, the interior of the shell 102 further includes tipping 114. The tipping 114 can be decorative-tipping, self-tipping, logo-tipping, and/or the like. The tipping 114 is positioned to cover the interlining 216 (FIG. 2) and hide (e.g., obscure) it from sight. In other embodiments, the tipping 114 can be omitted.

Figure 2:
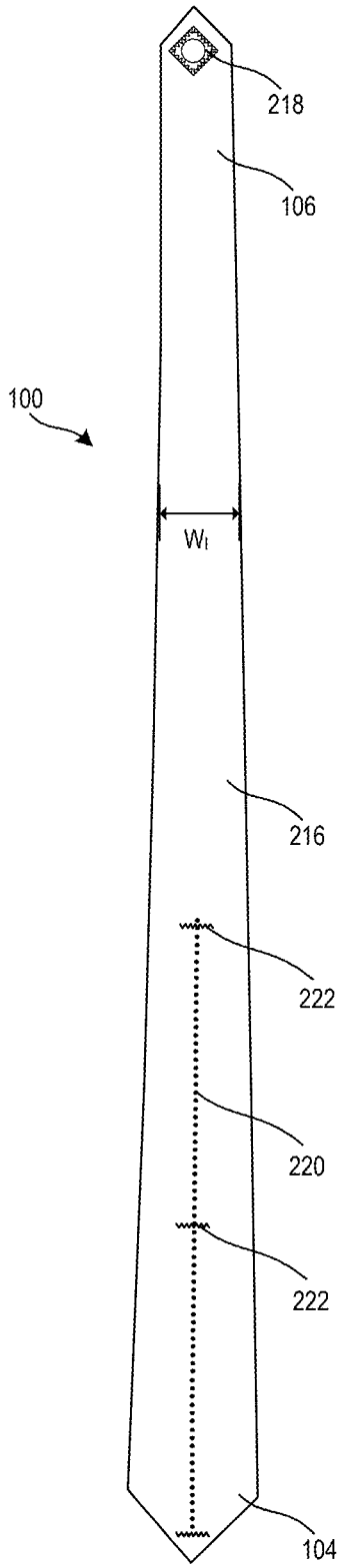
FIG. 2 is a view of the interlining of the necktie of FIGS. 1A and 1B.

FIG. 2 is a view of the interlining 216 of the necktie 100 of FIGS. 1A and 1B. In the illustrated embodiment, the interlining 216 has a width $W_I$, which is generally less than the width $W_S$ of the shell 102 (FIGS. 1A and 1B) measured along a length of interlining 216. For example, at the blade portion 104, the width $W_1$ of the interlining 216 is less than the width $W_S$ of the shell 102. As such, the interlining 216 can be placed within the folds of the shell 102, as described above.

In the illustrated embodiment, the interlining 216 includes a magnet 218 positioned at the tail portion 106 and a flexible (e.g., non-rigid) magnetic member 220 (e.g., ball chain, bead chain, strip, linkages) positioned at the blade portion 104. In some embodiments, the magnet 218 can be a sewing magnet (e.g., a waterproof neodymium magnet), a magnet lined with waterproof PVC plastic, or the like. In the illustrated embodiment, the magnet 218 is generally flat to minimize visibility of the magnet 218 (e.g., lumps in the necktie 100) to an outside observer. The magnet 218 can be affixed (e.g., fixedly coupled) to the interlining 216 via stitches, adhesive, and/or the like. The magnet 218 can have varying magnetic strengths depending on fabric weights and user preferences. In other embodiments, the magnet 218 can be removably inserted into a pouch of the necktie 100 to allow the wearer to exchange the magnet 218 depending on the desired magnetic strength. For example, neckties 100 with light-weight fabrics, such as silk, may include lower-strength magnets 218 to inhibit excessive attraction forces that could damage the delicate fabric.

In the illustrated embodiment, the magnetic member 220 has an elongated form factor and is affixed (e.g., fixedly coupled) to the interlining 216 via a plurality of stitches 222 ("stitches 222"). In the illustrated embodiment, there are three stitches 222, one at each end of the magnetic member 220 and one at the center (e.g., center portion) of the magnetic member 220. In other embodiments, more or fewer stitches 222 can be used to affix the magnetic member 220 and/or adhesives can be used. For example, stitches can be placed at each end of the magnetic member 220. In other embodiments, at least one stitch 222 is placed at the center of the magnetic member. Generally, the magnetic member 220 should extend from a tip of the blade portion 104 to a center of the necktie 100 (e.g., a neck portion). In some embodiments, the magnetic member 220 can consist of magnetic materials such as steel, iron, nickel, neodymium, and/or other magnetic metals or alloys. The magnetic member 220 can be coated (e.g., covered) with waterproofing material such as PVC plastic to inhibit the development of rust. In some aspects of the present technology, using a flexible magnetic member 220 allows the necktie 100 to lie naturally on the wearer (e.g., as if there were no securement device).

In the illustrated embodiment, the magnet 218 and the flexible magnetic member 220 are affixed to the interlining 216 on one side of the interlining 216 (e.g., an interior side). In other embodiments, the magnet 218 and the flexible magnetic member 220 can be attached to opposite sides of the interlining 216 (e.g., an interior side and an exterior side). In some embodiments, the magnetic member 220 and/or the magnet 218 can be further coupled to the necktie 100 via the bar tack described in greater detail above. In other embodiments, the magnet 218 and the magnetic member 220 can be replaced by complementary hook and loop features (e.g., Velcro®) snap features, adhesives, and/or the like. In further embodiments, the magnet 218 can be positioned at the blade portion 104, and the flexible magnetic member 220 can be positioned at the tail portion 106. In embodiments where the interlining 216 is omitted, the magnet 218 and the magnetic member 220 can be affixed directly to the shell 102.

Figure 3:
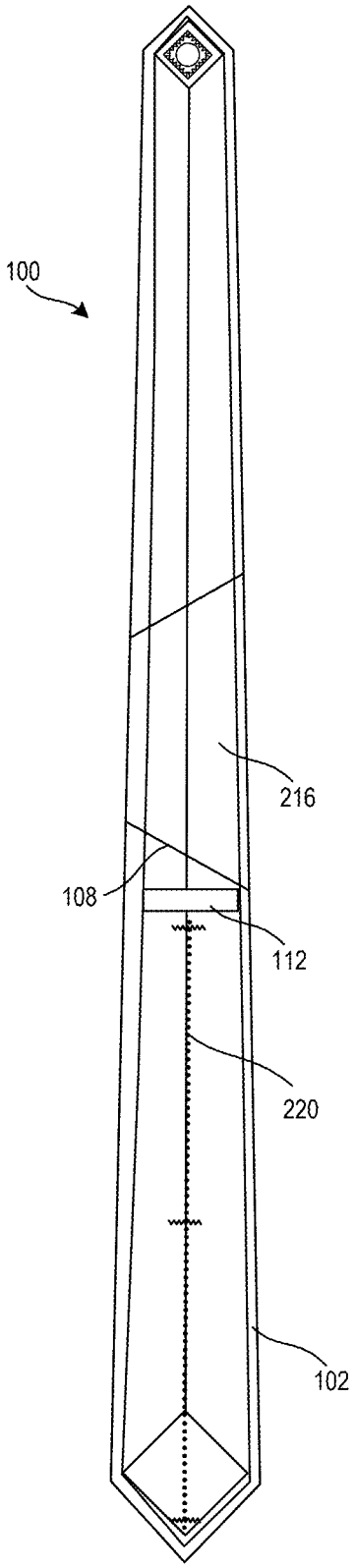
FIG. 3 is an interior view of an overlay of the shell and the interlining of the necktie of FIGS. 1A-2.

FIG. 3 is an interior view of an overlay of the shell 102 and the interlining 216 of the necktie 100 of FIGS. 1A-2. In the illustrated embodiment, both the shell 102 and the interlining 216 are shown, however, it should be understood that the interlining 216 is generally positioned within folds of the shell 102 and fixedly coupled to the shell 102. In the illustrated embodiment, the flexible magnet member 220 ends (e.g., terminates) at approximately the location of the keeper loop 112 and the seams 108. In some aspects of the present technology, this configuration can make it easier for the tie to be constructed using traditional necktie 100 manufacturing methods, such as sewing (e.g., joining) two pieces of fabric together at the seams 108. In other embodiments, the magnet member 220 can extend past the keeper loop 112 and/or the seams 108. In some embodiments, the magnet 218 and the magnetic member 220 can be affixed to a store-bought necktie by opening seams of the necktie and attaching them to the interlining and/or by affixing them to an exterior surface of the necktie.

Referring to FIGS. 1A-3, when the necktie 100 is tied around a wearer's neck, the blade portion 104 and the tail portion 106 align such that the blade portion 104 generally obscures the tail portion 106. Further, the magnet 218 aligns with a portion of the magnetic member 220 such that the magnet 218 and the magnetic member 220 are drawn together via magnetic forces. In some aspects of the present technology, this can inhibit or even prevent the tail portion 106 from moving beyond a footprint of the blade portion 104 to become visible to the outside observer. Further, because the magnet 218 is located at the end of the tail portion 106, the entire length of the tail portion 106 is secured behind the blade portion 104. In further aspects of the present technology, the elongate form of the flexible magnetic member 220 allows the wearer to establish a magnetic connection between the magnet 218 and the magnetic member 220 regardless of how the tie is tied. More specifically, regardless of the length of the tail portion 106 (e.g., the portion that extends past the neck on the back of the necktie 100), the magnet 218 will make a magnetic connection with the magnetic member 220 and secure the tail portion 106. In other aspects of the present technology, the necktie 100 does not have to be attached to the wearer's shirt to inhibit movement of the tail portion 106, allowing the necktie 100 to maintain its natural movements during wear.

In additional aspects of the present technology, affixing the magnet 218 and/or the magnetic member 220 to the interlining 216 hides (e.g., obscures, conceals, camouflages) the magnet 218 and/or magnetic member 220 from view once the interlining 216 has been sewn into the shell 102. Further, the shell 102 can act as a restraint on the magnetic member 220 to inhibit movement (e.g., swinging) of the magnetic member 220.

The above detailed descriptions of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, the various embodiments described herein may be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A necktie comprising:

a shell forming an exterior surface of the necktie, the shell including a first blade portion and a first tail portion;

an interlining positioned within the shell, the interlining including a second blade portion and a second tail portion that aligns with the first blade portion and the first tail portion, respectively;

a magnet affixed to a tip of the second tail portion; and an elongate magnetic member affixed to the second blade portion, wherein the magnet is magnetically attracted to the elongate magnetic member to secure the first blade portion to the first tail portion.

2. The necktie of claim 1 wherein the elongate magnetic member is secured to the interlining by a plurality of stitches.

3. The necktie of claim 2 wherein the plurality of stitches includes stitches positioned at each end of the elongate magnetic member and at least one stitch positioned at a center portion of the elongate magnetic member.

4. The necktie of claim 1 wherein the elongate magnetic member comprises a ball chain.

5. The necktie of claim 1 wherein the magnet comprises a waterproof neodymium sewing magnet.

6. The necktie of claim 1 wherein the elongate magnetic member extends from a tip of the second blade portion to a center portion of the interlining.

7. The necktie of claim 1 wherein the shell further comprises a keeper loop positioned on the first blade portion.

8. The necktie of claim 7 wherein the elongate magnetic member terminates at approximately a location of the keeper loop.

9. The necktie of claim 1 wherein the shell further comprises seams joining fabric pieces of the shell, and wherein the elongate magnetic member terminates at approximately a location of the seams.

10. The necktie of claim 1 wherein the elongate magnetic member is flexible.

11. A necktie comprising:

a shell having a blade portion and a tail portion;

a magnet coupled to the tail portion; and an elongate magnetic member coupled to the blade portion via a plurality of stitches, wherein the elongate magnetic member is configured to magnetically couple with the magnet to secure the tail portion against the blade portion.

12. The necktie of claim 11 wherein the magnet is positioned at a tip of the tail portion.

13. The necktie of claim 11 wherein the necktie comprises tipping configured to hide all or part of the magnet or the elongate magnetic member.

14. The necktie of claim 11 wherein the elongate magnetic member is a steel ball chain.

15. The necktie of claim 11 wherein the magnet comprises features that are waterproof.

16. The necktie of claim 11, further comprising a bar tack configured to secure a seam of the shell or to secure the elongate magnetic member.

17. A method of securing a necktie tail comprising:

obtaining a necktie having a blade portion and a tail portion;

coupling a magnet at a tip of the tail portion;

coupling an elongate magnetic member along the blade portion; and magnetically coupling the magnet with the elongate magnetic member to secure the tail portion to the blade portion when the necktie is worn.

18. The method of claim 17 wherein coupling the magnet further comprises affixing the magnet to an interlining positioned within the tail portion.

19. The method of claim 17 wherein coupling the elongate magnetic member comprises affixing the elongate magnetic member to an interlining within the blade portion using a plurality of stitches.

20. The method of claim 17 wherein obtaining the necktie further comprises obtaining a shell and sewing the shell into a form of the necktie.

* * * * *